United States Patent [19]

St. Fort

[11] 4,080,029

[45] Mar. 21, 1978

[54] PLUG LOCK

[76] Inventor: Raymond St. Fort, 45 Argyle Rd., 1-C, Brooklyn, N.Y. 11218

[21] Appl. No.: 665,784

[22] Filed: Mar. 10, 1976

[51] Int. Cl.[2] ..... H01R 13/54

[52] U.S. Cl. ..... 339/34; 339/45 R; 339/82

[58] Field of Search ..... 339/34, 45 R, 45 M, 339/75 P, 82

[56] References Cited

U.S. PATENT DOCUMENTS

| | | | |
|---|---|---|---|
| 2,259,799 | 10/1941 | Corrigan | 339/45 R |
| 3,345,603 | 10/1967 | Cohen | 339/82 |
| 3,428,936 | 2/1969 | Arnao | 339/75 P |
| 3,433,886 | 3/1969 | Myers | 339/34 |
| 3,601,757 | 8/1971 | Gober | 339/75 P |
| 3,926,494 | 12/1975 | Maillaro | 339/34 |

*Primary Examiner*—Roy Lake
*Assistant Examiner*—Mark S. Bicks
*Attorney, Agent, or Firm*—Allen D. Brufsky

[57] ABSTRACT

An electrical connector comprising a male plug is assembled in a housing which is permanently secured to a wall outlet, the male plug being movable forwardly in the housing into engagement with the terminals of the wall outlet, the housing having a key-operated lock arranged to lock the male plug in its forward position in the housing.

4 Claims, 3 Drawing Figures

PLUG LOCK

BACKGROUND OF INVENTION

Many electric plugs have been designed with locking means adapted to releasably lock the plug in a wall outlet to prevent accidental uncoupling of the plug. However almost without exception the releasable locking means of the prior art take the form of spring-loaded pushbuttons designed to disengage the plug from a wall outlet simply by manual manipulation, typical of which are the releasable locking means shown in U.S. Pat. Nos. 3,676,831 Bergwall 7/11/72; 3,267,408 Baker et al. 8/16/66; 2,985,119 Montgomery, Jr. 7/14/59 and 2,885,650 Miller et al 5/5/59. Other forms of releasable locking means have taken the form of cam arrangements wherein partial rotation of one element of the plug retracts the plug locking means, as illustrated by U.S. Pat. Nos. 3,159,445 Wolk 12/1/64 and 2,750,570 Bates 6/12/56.

However while these and similar plug locking means serve to prevent inadvertant or accidental disengagement of a plug from its wall outlet the plug can be readily unlocked by anyone in a relatively quick and simple manner.

However with the increase in crime rate and in particular the number of home burglaries which take place annually wherein homes are ransacked of portable electrical appliances such as TV sets, Hi-Fi equipment, radios, lamps and the like such losses could be prevented or at least significantly reduced provided the plugs of such electrical appliances are locked to the wall outlets in a manner such that the plugs could be released only by authorized persons.

SUMMARY OF INVENTION

The present invention therefore relates in general to electrical male plugs adapted to be locked in a wall outlet; and more particularly to an electrical male plug assembly provided with locking means so designed that the male plug per se cannot be removed from the wall outlet except by the use of a key.

In brief the electrical male plug assembly of this invention comprises a cylindrical housing one end of which is adapted to be fixedly secured to a wall outlet. The electrical male plug is mounted within the housing for longitudinal movement therein to and from engagement i.e. electrical contact, with the terminals of the wall outlet box. The male plug is adapted to be moved forwardly manually in the housing against the restraining force of a coil spring; and a key-operated tumbler serves to lock the plug in its forward or operative position in the housing. Thus the plug cannot be withdrawn from the wall outlet except by using the key to release the tumbler whereupon the coil spring will return the male plug to its rearward or inoperative position in the housing thereby disconnecting the male plug from the wall outlet.

PREFERRED EMBODIMENT OF THE INVENTION

Figure 1:
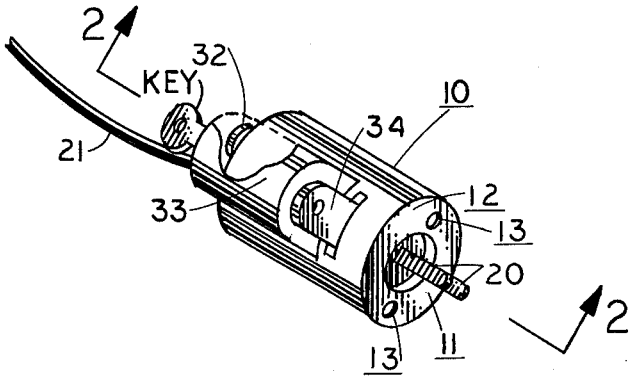
FIG. 1 is a perspective view of the lockable electrical male plug assembly of this invention shown detached from the wall outlet box.

Referring to the drawings the housing of the lockable electrical plug is indicated at 10 and is preferably substantially cylindrical and made of a suitable material such as metal or rigid plastic. The forward end 11 of the housing is provided with a central aperture 12 on opposite sides of which are internally threaded holes 13—13 adapted to receive machine screws for permanently securing the forward end of the housing to a wall outlet box, as described in more detail below.

Figure 2:
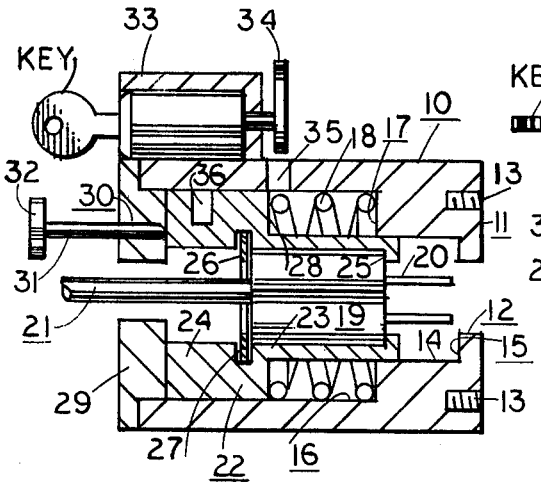
FIG. 2 is a vertical section of the lockable electrical plug assembly on line 2—2 of FIG. 1 showing the male plug retracted within its housing.

Referring to FIG. 2 the opposite or rear end of the housing is provided with an axial counterbore 14 which terminates adjacent the forward end of the housing in an annular shoulder 15. The counterbore 14 is, in turn, formed with a concentric counterbore 16 the forward end of which terminates in an annular shoulder 17 which forms a seat for the forward end of coil compression spring 18.

The male plug, per se, is indicated at 19 and has two forwardly extending terminals 20—20 electrically connected to a cord or cable 21 at the rear end of the plug. The male plug 19 is adapted to be assembled in carrier-means indicated generally at 22, for forward and rearward movement in the housing 10. To this end the carrier-means 22 comprises a hollow cylindrical member formed of metal or rigid plastic having a cylindrical lead-portion 23 to the rear of which is a cylindrical enlargement 24 the diameter of the lead-portion 23 corresponding substantially to the diameter of the axial counterbore 14; and the diameter of its enlargement 24 corresponding substantially to the diameter of the concentric counterbore 16 — whereby the carrier-means 22 is slidably supported for movement forwardly and rearwardly in the housing 10.

The internal diameter of the hollow cylindrical lead-portion 23 corresponds substantially to the diameter of the electrical male plug 19 which is mounted in the forward end of the lead-portion 23 against an annular shoulder 25; and is adapted to be held securely against rearward displacement therein by means of a lock-washer 26 snapped into an annular groove 27 in the inner wall of the enlarged portion 24 of the cylindrical carrier-means 22.

The aforementioned coil compression spring 18 is retained in an annular space between the lead-portion 23 of the carrier-means 22 and the counterbore 16, the opposite ends of the coil spring abutting the annular shoulder 17 of the housing and the annular shoulder 28 of the carrier-means 22, respectively.

The coil spring 18 is adapted normally to be under compression so as to urge the carrier means 22 rearwardly in the housing — rearward displacement of the carrier-means 22 being limited by a flanged disc-shaped end-member 29 fixedly secured in any suitable manner in the rear end of the housing 22. The flanged end-member 29 has a central aperture for accomodating the electric cord 21; and an assymetrically located aperture 30 adapted to accomodate a push pin 31 having enlarged head 32, the push pin being so positioned that its inner end engages the rear end of the carrier-means 22. By pushing forwardly on the pin 31 the carrier-means 22 and its male plug 19 are moved forwardly in the housing 10 whereby the male terminals 20—20 are extended beyond the forward end of the housing 10 for engagement with conventional female terminals of a wall outlet box.

Figure 3:
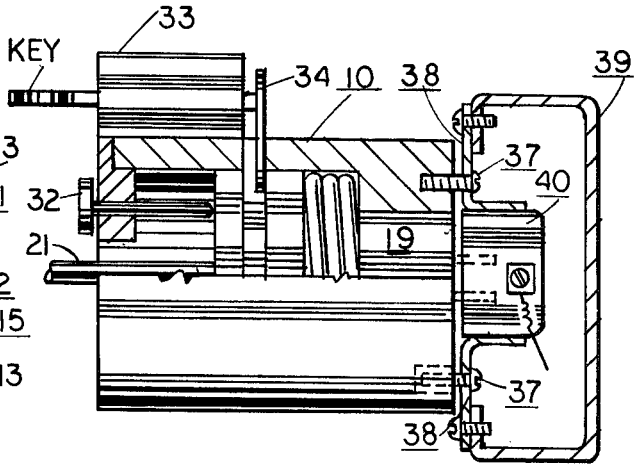
FIG. 3 is a vertical elevation partially in section in which the housing of the assembly is secured to a wall outlet box — the male plug being in its forward position in electrical contact with the female terminals of the wall outlet box.

Pursuant to the objects of the invention the electrical male plug is adapted to be locked in its forward operative position in the housing 10 by suitable locking means indicated generally at 33. The latter is fixedly secured, as by welding or soldering, to the housing 10 and includes a conventional key-operated tumbler 34 the latter arranged to be rotated into and from a slotted aperture 35 in the housing 10. As shown in FIG. 3 when the male plug is moved into its forward operative position in the housing a groove or detent 36 formed in the top of the enlargement 24 of the carrier-member 22 is substantially directly below the slot 35 of the housing so that when the key-operated tumbler 34 is moved into locking position it projects through the slot 35 of the housing into the detent 36 of the carrier-member thus locking it and its male plug in forward operative position in the housing.

As mentioned above the housing 10 is adapted to be fixedly secured to a wall outlet box. To this end the forward end of the housing is provided with the aforesaid screw holes 13—13 which, as shown especially well in FIG. 3, are adapted to receive screws 37—37 accomodated in holes suitably located in the conventional plug-socket saddle 38 of a wall box indicated generally at 39. Thus when the electrical male plug is advanced and locked in its forward operative position in the housing 10 its male terminals 20—20 enter and make electrical contact with the female terminals of the plug-socket 40 of the wall box 39.

The electrical plug will thus be securely locked to the wall outlet against unlawful removal until such time as the key is inserted in the lock 33 to withdraw the tumbler 34 from engagement with the carrier member 22 — whereupon the compressed coil spring 18 will move the carrier rearwardly in the housing thus withdrawing the male terminals of the plug from the socket of the wall outlet.

The invention may be carried out in other specific ways than those herein set forth without departing from the spirit and essential characteristics of the invention and the present embodiment is therefore to be considered in all respects as illustrative and not restrictive, and all changes coming within the meaning and equivalency range of the appended claims are intended to be embraced therein.

I claim:

1. A lockable electric plug assembly comprising, in combination: a wall outlet, a housing constructed and arranged to be fixedly secured to said wall outlet, carrier-means arranged to be reciprocably mounted in said housing, said carrier means having a locking detent, a conventional male plug assembled in said carrier means and arranged to be moved forwardly by said carrier means into operative engagement with said wall outlet, manually operated means arranged to engage and move said carrier-means forwardly in said housing, key-operated locking means mounted on said housing and arranged to engage the detent of said carrier means and lock said carrier means in its forward position in said housing wherein said male plug is in operative engagement with said wall outlet, and resilient means in said housing arranged to move said carrier-means, with said male plug, rearwardly in said housing when said carrier means is unlocked by said key-operated locking means thereby to disengage said male plug from said wall outlet.

2. A lockable electric plug assembly according to claim 1 wherein said manually operated means comprises a push pin mounted in said housing in operative engagement with said carrier-means.

3. A lockable electric plug assembly according to claim 2 wherein said resilient means comprises a coil spring assembled in said housing in engagement with the forward end of said carrier-means for resisting, normally, the forward movement of said carrier-means in said housing.

4. A lockable electric plug assembly according to claim 3 wherein said key-operated locking means is integral with said housing.

* * * * *